US007051823B2

(12) United States Patent
Bosch et al.

(10) Patent No.: US 7,051,823 B2
(45) Date of Patent: May 30, 2006

(54) DRIVE SYSTEM FOR A MOTOR VEHICLE COMPRISING AN ELECTRIC MACHINE

(75) Inventors: Hermann Bosch, Esslingen (DE); Roland Kemmler, Stuttgart (DE); Juergen Lang, Backnang (DE); Dietrich Sahm, Bad Urach (DE); Hubert Schnuepke, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/513,177

(22) PCT Filed: Mar. 15, 2003

(86) PCT No.: PCT/EP03/02729

§ 371 (c)(1),
(2), (4) Date: Jun. 1, 2005

(87) PCT Pub. No.: WO03/093663

PCT Pub. Date: Nov. 13, 2003

(65) Prior Publication Data

US 2005/0205312 A1 Sep. 22, 2005

(30) Foreign Application Priority Data

May 2, 2002 (DE) ..... 102 19 695

(51) Int. Cl.
*B60K 1/00* (2006.01)

(52) U.S. Cl. ..... 180/65.1; 123/179.28

(58) Field of Classification Search ..... 123/179.25, 123/179.28, 179.3, 179.4; 180/65.1
See application file for complete search history.

(56) References Cited

U.S. PATENT DOCUMENTS

| | | | | |
|---|---|---|---|---|
| 6,032,632 | A | 3/2000 | Bolenz et al. | |
| 6,326,761 | B1 * | 12/2001 | Tareilus | 318/722 |
| 6,378,479 | B1 * | 4/2002 | Nishidate et al. | 123/179.25 |
| 6,571,895 | B1 * | 6/2003 | Weimer | 180/65.1 |
| 6,725,821 | B1 * | 4/2004 | Warren et al. | 123/179.3 |
| 2001/0022243 | A1 | 9/2001 | Weimer | |
| 2005/0022770 | A1 * | 2/2005 | Yuminiyama et al. | 123/179.4 |

FOREIGN PATENT DOCUMENTS

| | | | |
|---|---|---|---|
| DE | 3332515 | A1 | 3/1985 |
| DE | 4442867 | C2 | 9/1999 |
| DE | 19941705 | A1 | 3/2000 |
| DE | 19926612 | A1 | 12/2000 |
| DE | 19949931 | A1 | 4/2001 |
| DE | 19952625 | A1 | 6/2001 |

* cited by examiner

*Primary Examiner*—Henry C. Yuen
*Assistant Examiner*—Arnold Castro
(74) *Attorney, Agent, or Firm*—Crowell & Moring LLP

(57) ABSTRACT

A drive system for a motor vehicle includes an internal combustion engine and a transmission. The internal combustion engine has an associated driveshaft, the transmission has an associated transmission shaft, and the driveshaft and the transmission shaft are connected to one another. A free installation space is provided between the internal combustion engine and the transmission in the direction of the driveshaft and, respectively, of the transmission shaft. The internal combustion engine has an associated electric machine which can be operated as a starter/generator. The electric machine has an associated power electronics unit which is arranged in the free installation space.

9 Claims, 2 Drawing Sheets

DRIVE SYSTEM FOR A MOTOR VEHICLE COMPRISING AN ELECTRIC MACHINE

BACKGROUND AND SUMMARY OF THE INVENTION

This invention relates to a drive system for a motor vehicle comprising an internal combustion engine and a transmission.

Laid-open German specification DE 199 26 612 A1 discloses a belt drive for an internal combustion engine which has a crankshaft and a starter/generator. In this case, the crankshaft is provided with a first belt pulley and the starter/generator is provided with a second belt pulley. One belt wraps around both of the belt pulleys.

Laid-open German specification DE 33 32 515 A1 discloses an electric machine which has an associated converter appliance for driving purposes. The converter appliance is installed in a terminal box on a planar contact area. The terminal box is provided in the housing wall of the electric machine.

In drive systems for vehicles, little installation space is customarily available for the installation of, in particular, optional components, for example of a power electronics unit and/or a starter/generator. Additional installation often requires expensive reconstruction of the original drive system comprising an internal combustion engine and a transmission. A vehicle series usually has a wide range of internal combustion engines and transmissions. If the internal combustion engines have associated electric machines, in particular starter/generators, different embodiments of starter/generators are therefore also conceivable here in order to allow the vehicle series to be designed in a flexible manner. Belt-driven electric machines are customarily used for internal combustion engines with a small volume, whereas integrated electric machines are preferably used for internal combustion engines with a large volume. An integrated electric machine is understood to mean an electric machine which is arranged between an internal combustion engine and a transmission. In addition to the installation space required for the electric machine, the vehicle must also have enough installation space for a power electronics unit associated with the electric machine, and any energy stores, cooling units and further electrical components which may be present. The electric machine is preferably used for start/stop operation of the motor vehicle. Start/stop operation leads to a saving in terms of consumption and to a reduction in the environmental pollution caused by exhaust gases and emissions.

An object of the invention is to provide a drive system comprising an electric machine which requires as little installation space as possible.

This object is achieved by means of a drive system as claimed.

The drive system according to the invention is distinguished by a power electronics unit being integrated in the drive system in an installation space-saving manner. This results in a compact design and advantages in terms of packaging. The integrated design also results in improved electromagnetic compatibility since only short electrical lines are required. This is particularly favorable in modern vehicles which customarily contain a large number of electrical components, such as controllers. One refinement of the invention provides more installation space or volume for a power electronics unit even in the case of drive systems which have a large transmission bell housing and which are designed for a high starting torque.

Further advantageous refinements of the invention may be found in the subclaims and in the exemplary embodiments described in the following text with reference to the drawings.

DESCRIPTION OF THE INVENTION

Figure 1:
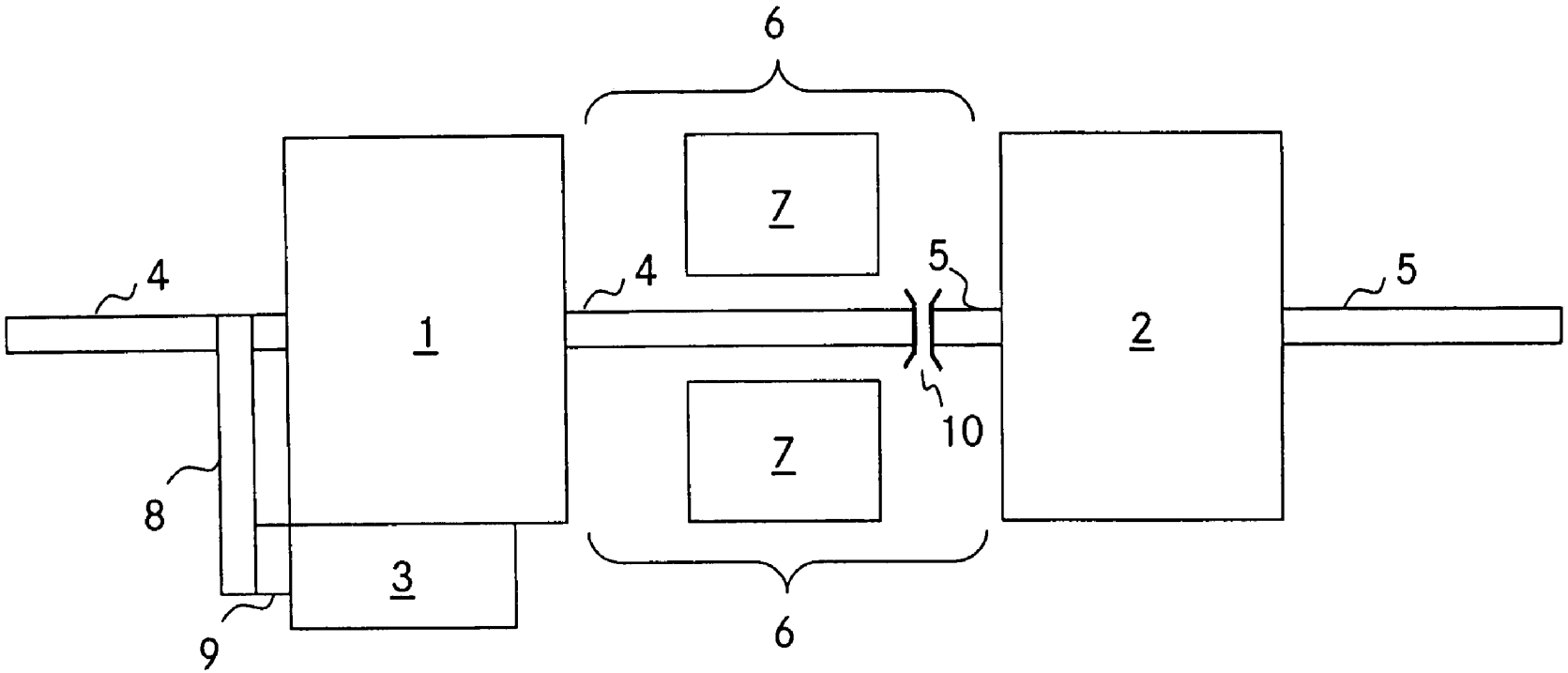
FIG. 1 shows a schematic illustration of a preferred embodiment of a drive system according to the invention.

FIG. 1 schematically illustrates a preferred embodiment of a drive system according to the invention. The drive system has an internal combustion engine 1, a transmission 2 and an electric machine 3. The internal combustion engine 1 has an associated driveshaft or crankshaft 4. The transmission 2 has an associated transmission shaft 5. The driveshaft 4 and the transmission shaft 5 are preferably connected to one another by means of a clutch 10. The transmission 2 may also comprise a converter or a torque converter. The transmission 2 may be operated manually or automatically. A free installation space 6 is provided between the internal combustion engine 1 and the transmission 2 in the direction of the driveshaft 4 and, respectively, of the transmission shaft 5. The electric machine 3 is associated with the internal combustion engine 1 and is preferably operated as a starter/generator. The electric machine 3 may also additionally be operated as a motor and may assist the internal combustion engine 1, for example, when the motor vehicle is accelerated (what is known as boosting). A power electronics unit 7, which according to the invention is arranged in the free installation space 6 between the internal combustion engine 1 and the transmission 2, is provided in order to drive the electric machine 3. This power electronics unit 7 comprises the customary components required to operate an electric machine 3, such as converters comprising semiconductor switches (for example transistors) or power semiconductors, free-wheeling diodes, additional power semiconductors, a current or voltage source if appropriate, and any protective switches and electrical lines which may be present. The power semiconductors used are preferably MOSFETs and/or IGBTs. The electric machine 3 used is customarily a three-phase machine. Each phase or each rotor section of the electric machine 3 is typically activated by means of power semiconductors which are interconnected as half-bridges.

The power electronics unit 7 is preferably formed such that it is of at least partially annular design and at least partially surrounds the driveshaft 4 and/or the transmission shaft 5. A housing (not illustrated) of the power electronics unit 7 is preferably of corresponding design.

The electric machine 3 is preferably drive-connected to the driveshaft 4 of the internal combustion engine 1 by means of a belt. For this purpose, the driveshaft 4 typically has a first belt pulley (not illustrated). The electric machine 3 has a second associated belt pulley 9. The belt 8 wraps around both of these belt pulleys. Tensioning devices (not illustrated) may be provided for tensioning the belt 8. In this embodiment, the electric machine 3 is preferably connected to a housing 8 of the internal combustion engine 1 with a form fit. As an alternative, the electric machine 3 may be arranged in the motor vehicle at a distance from the internal combustion engine 1.

Flexibility when designing a vehicle series may, for example, be increased by using different electric machines. Therefore, the volume or the size of the free installation space 6 is preferably chosen such that when an integrated electric machine is used instead of a belt-driven electric machine 3, the integrated machine can be integrated in the free installation space 6 in addition to or in place of the power electronics unit 7. This flexible utilization of the free installation space 6 allows, for example, different systems for implementing start/stop operation to be used in one vehicle series. In addition to advantages in terms of packaging, this also has cost advantages since expensive restructuring of a drive train or drive system can be avoided.

Figure 2:
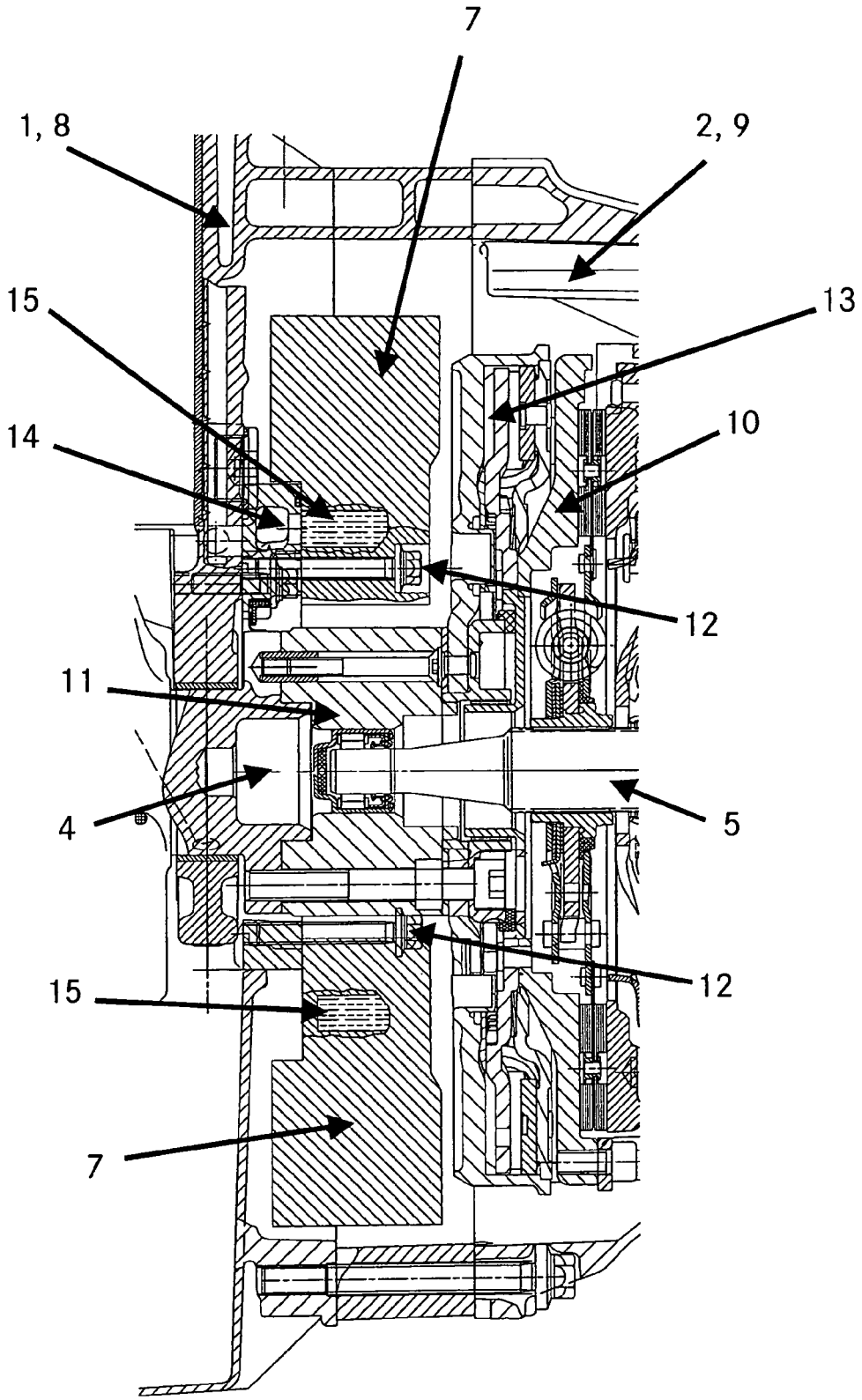
FIG. 2 shows a longitudinal section through a detail of an assembly drawing of a drive system according to the invention.

FIG. 2 illustrates a longitudinal section through a detail of an assembly drawing of a drive system according to the invention. Functionally identical components are provided with the same reference symbols as in FIG. 1. As already illustrated in FIG. 1, a fixed power electronics unit 7 is provided between the internal combustion engine 1 or its housing 8 and the transmission 2 or its housing 9. The driveshaft or crankshaft 4 associated with the internal combustion engine 1 and the transmission shaft 5 associated with the transmission 2 are preferably connected by means of an intermediate flange 11 and a clutch 10. The power electronics unit 7 is preferably of at least partially annular design and preferably at least partially surrounds the junction of the driveshaft 4 and transmission shaft 5. A fixing means 12 is provided which fixes the power electronics unit 7 to the housing 8 of the internal combustion engine. A flywheel 13 can preferably be provided between the power electronics unit 7 and clutch 10 in the drive system according to the invention and may be used to increase the uniformity of the rotational movement of the shafts or to increase the mass moment of inertia. The power electronics unit 7 preferably has a cooling unit, of which cooling ducts 15 and a coolant transfer passage 14 are illustrated by way of example in FIG. 2. Cooling is preferably performed by means of air and/or water.

In addition to the power electronics unit 7, it is possible, preferably depending on the variant, to integrate into the free installation space 6, an additional power or energy store (not illustrated), a circuit breaker (not illustrated) or a switching element, for example a protective switch, a DC/DC converter (not illustrated) and further, in particular electrical components, for example a controller or a control unit. The power or energy store used may preferably be what is known as an Ultracap capacitor and/or an additional battery which may be provided in addition to the vehicle battery customarily contained in the vehicle and integrated in the on-board electrical system. The electric machine 3 is designed such that it can also be operated as a generator, in order, for example, to convert the braking energy released when the vehicle or the internal combustion engine 1 is braked into electrical energy. This electrical energy is preferably fed to an on-board electrical system of the vehicle and/or to a power or energy store by means of a DC/DC converter (this is known as recuperation).

In addition to the power electronics unit 7, a second electric machine (not illustrated) which is preferably used to start the internal combustion engine 1 may be provided in the free installation space 6. This second electric machine is also referred to as an additional starter. The second electric machine is preferably connected to the power electronics unit 7 with a form fit. The power semiconductors or semiconductor elements, in particular a converter, required to drive this second electric machine may be integrated in the power electronics unit. The second electric machine is preferably arranged at the point radially furthest away from the driveshaft 4 or from the transmission shaft 5, or on the side of the power electronics unit 7 which is radially furthest away.

The invention claimed is:

1. A drive system for a motor vehicle comprising:

an internal combustion engine having an associated driveshaft and an associated electric machine which can be operated as a starter/generator, and a transmission having an associated transmission shaft, wherein the driveshaft and the transmission shaft are connected to one another and a free installation space is provided between the internal combustion engine and the transmission, wherein the electric machine is drive-connected to the driveshaft of the internal combustion engine by a belt, wherein the electric machine has an associated power electronics unit, and wherein the power electronics unit is arranged in the free installation space.

2. The drive system as claimed in claim 1, wherein the power electronics unit is of at least partially annular design and at least partially surrounds at least one of the driveshaft and the transmission shaft.

3. The drive system as claimed in claim 1, wherein the electric machine is connected to a housing of the internal combustion engine with a form fit.

4. The drive system as claimed in claim 1, wherein a switching element is additionally arranged in the free installation space.

5. The drive system as claimed in claim 1, wherein an energy store is additionally arranged in the free installation space.

6. The drive system as claimed in claim 1, wherein a DC/DC converter is additionally arranged in the free installation space.

7. The drive system as claimed in claim 1, wherein the power electronics unit has a cooling unit.

8. The drive system as claimed in claim 1, wherein a second electric machine for starting the internal combustion engine is additionally arranged in the free installation space.

9. The drive system as claimed in claim 8, wherein the second electric machine is connected to the power electronics unit with a form fit.

* * * * *